US007455538B2

(12) United States Patent
Germain

(10) Patent No.: US 7,455,538 B2
(45) Date of Patent: Nov. 25, 2008

(54) ELECTRICAL WIRING DEVICES WITH A PROTECTIVE SHUTTER

(75) Inventor: Frantz Germain, Rosedale, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/218,029

(22) Filed: Aug. 31, 2005

(65) Prior Publication Data

US 2007/0049077 A1 Mar. 1, 2007

(51) Int. Cl.
*H01R 13/44* (2006.01)

(52) U.S. Cl. ..... 439/137

(58) Field of Classification Search ..... 439/135–150
See application file for complete search history.

(56) References Cited

U.S. PATENT DOCUMENTS

| | | | | |
|---|---|---|---|---|
| 2,540,496 | A | 2/1951 | Sperrazza | |
| 2,826,652 | A | 3/1958 | Piplack | |
| 2,926,327 | A | 2/1960 | Metelli | |
| 3,222,631 | A | 12/1965 | Cohen | |
| 3,238,492 | A | 3/1966 | Houston | |
| 3,309,571 | A | 3/1967 | Gilker | |
| 3,538,477 | A | 11/1970 | Walters et al. | |
| 3,617,662 | A | 11/1971 | Miller | |
| 3,702,418 | A | 11/1972 | Obenhaus | |
| 3,731,154 | A | 5/1973 | Torosian | |
| 3,766,434 | A | 10/1973 | Sherman | |
| 3,775,726 | A | 11/1973 | Gress | |
| 3,813,579 | A | 5/1974 | Doyle et al. | |
| 3,864,649 | A | 2/1975 | Doyle | |
| 3,872,354 | A | 3/1975 | Nestor et al. | |
| 3,949,336 | A | 4/1976 | Dietz | |
| 3,986,763 | A | 10/1976 | Sparrow | |
| 3,990,758 | A * | 11/1976 | Petterson | 439/138 |
| 4,002,951 | A | 1/1977 | Halbeck | |
| 4,010,431 | A | 3/1977 | Virani et al. | |
| 4,010,432 | A | 3/1977 | Klein et al. | |
| 4,013,929 | A | 3/1977 | Dietz et al. | |
| 4,034,266 | A | 7/1977 | Virani et al. | |
| 4,034,360 | A | 7/1977 | Schweitzer, Jr. | |
| 4,051,544 | A | 9/1977 | Vibert | |
| 4,063,299 | A | 12/1977 | Munroe | |
| 4,072,382 | A | 2/1978 | Reschke | |
| 4,086,549 | A | 4/1978 | Slater et al. | |
| 4,109,226 | A | 8/1978 | Bowling et al. | |
| 4,114,123 | A | 9/1978 | Grenier | |
| 4,148,536 | A | 4/1979 | Petropoulsos et al. | |
| 4,159,499 | A | 6/1979 | Bereskin | |
| 4,163,882 | A | 8/1979 | Baslow | |
| 4,168,104 | A | 9/1979 | Buschow | |
| 4,194,231 | A | 3/1980 | Klein | |
| 4,223,365 | A | 9/1980 | Moran | |
| 4,237,435 | A | 12/1980 | Cooper et al. | |
| 4,271,337 | A | 6/1981 | Barkas | |

(Continued)

FOREIGN PATENT DOCUMENTS

| | | |
|---|---|---|
| AU | 759587 | 7/2003 |

(Continued)

*Primary Examiner*—Ross N Gushi
(74) *Attorney, Agent, or Firm*—Collard & Roe, P.C.

(57) ABSTRACT

Electrical wiring devices with user accessible connections and a shutter system for preventing unwanted objects from being inserted into the devices to the user accessible connections is provided.

9 Claims, 3 Drawing Sheets

U.S. PATENT DOCUMENTS

| | | | | |
|---|---|---|---|---|
| 4,288,768 | A | | 9/1981 | Arnhold et al. |
| 4,316,230 | A | | 2/1982 | Hansen et al. |
| 4,377,837 | A | | 3/1983 | Matsko et al. |
| 4,379,607 | A | | 4/1983 | Bowden, Jr. |
| 4,386,338 | A | | 5/1983 | Doyle et al. |
| 4,409,574 | A | | 10/1983 | Misencik et al. |
| 4,412,193 | A | | 10/1983 | Bienwald et al. |
| 4,442,470 | A | | 4/1984 | Misencik |
| 4,515,945 | A | | 5/1985 | Ranken et al. |
| 4,518,945 | A | | 5/1985 | Doyle et al. |
| 4,521,824 | A | | 6/1985 | Morris et al. |
| 4,538,040 | A | | 8/1985 | Ronemus et al. |
| 4,544,219 | A | | 10/1985 | Barkas |
| 4,567,456 | A | | 1/1986 | Legatti |
| 4,568,899 | A | | 2/1986 | May et al. |
| 4,574,260 | A | | 3/1986 | Franks |
| 4,578,732 | A | | 3/1986 | Draper et al. |
| 4,587,588 | A | | 5/1986 | Goldstein |
| 4,595,894 | A | * | 6/1986 | Doyle et al. ..... 335/18 |
| 4,603,932 | A | | 8/1986 | Heverly |
| 4,630,015 | A | | 12/1986 | Gernhardt et al. |
| 4,631,624 | A | | 12/1986 | Dvorak et al. |
| 4,641,216 | A | | 2/1987 | Morris et al. |
| 4,641,217 | A | | 2/1987 | Morris et al. |
| 4,686,600 | A | | 8/1987 | Morris et al. |
| 4,714,858 | A | | 12/1987 | Sanders |
| 4,719,437 | A | | 1/1988 | Yun |
| 4,722,693 | A | * | 2/1988 | Rose ..... 439/137 |
| 4,802,052 | A | | 1/1989 | Brant et al. |
| 4,814,641 | A | | 3/1989 | Dufresne |
| 4,816,957 | A | | 3/1989 | Irwin |
| 4,851,951 | A | | 7/1989 | Foster, Jr. |
| 4,867,693 | A | | 9/1989 | Gizienski et al. |
| 4,867,694 | A | | 9/1989 | Short |
| 4,897,049 | A | | 1/1990 | Miller et al. |
| 4,901,183 | A | | 2/1990 | Lee |
| 4,936,789 | A | | 6/1990 | Ugalde |
| 4,949,070 | A | | 8/1990 | Wetzel |
| 4,967,308 | A | | 10/1990 | Morse |
| 4,979,070 | A | | 12/1990 | Bodkin |
| 5,006,075 | A | | 4/1991 | Bowden, Jr. |
| 5,020,997 | A | | 6/1991 | Calderara et al. |
| 5,069,630 | A | | 12/1991 | Tseng et al. |
| 5,144,516 | A | | 9/1992 | Sham |
| 5,148,344 | A | | 9/1992 | Rao et al. |
| 5,161,240 | A | | 11/1992 | Johnson |
| 5,179,491 | A | | 1/1993 | Runyan |
| 5,185,687 | A | | 2/1993 | Beihoff et al. |
| 5,202,662 | A | | 4/1993 | Bienwald et al. |
| 5,218,331 | A | | 6/1993 | Morris et al. |
| 5,223,810 | A | | 6/1993 | Van Haaren |
| 5,224,006 | A | | 6/1993 | MacKenzie et al. |
| 5,229,730 | A | | 7/1993 | Legatti et al. |
| 5,239,438 | A | | 8/1993 | Echtler |
| 5,277,607 | A | | 1/1994 | Thumma et al. |
| 5,293,522 | A | | 3/1994 | Fello et al. |
| 5,320,545 | A | | 6/1994 | Brothers |
| 5,347,248 | A | | 9/1994 | Herbert |
| 5,363,269 | A | | 11/1994 | McDonald |
| 5,374,199 | A | | 12/1994 | Chung |
| 5,391,085 | A | | 2/1995 | Tigner |
| 5,418,678 | A | | 5/1995 | McDonald |
| 5,448,443 | A | | 9/1995 | Muelleman |
| 5,477,412 | A | | 12/1995 | Neiger et al. |
| 5,510,760 | A | | 4/1996 | Marcou et al. |
| 5,515,218 | A | | 5/1996 | DeHaven |
| 5,517,165 | A | | 5/1996 | Cook |
| 5,518,132 | A | | 5/1996 | Chen |
| 5,541,800 | A | | 7/1996 | Misencik |
| 5,551,884 | A | | 9/1996 | Burkhart, Sr. |
| 5,555,150 | A | | 9/1996 | Newman, Jr. |
| 5,576,580 | A | | 11/1996 | Hosoda et al. |
| 5,594,398 | A | | 1/1997 | Marcou et al. |
| 5,600,524 | A | | 2/1997 | Neiger et al. |
| 5,617,284 | A | | 4/1997 | Paradise |
| 5,625,285 | A | | 4/1997 | Virgilio |
| 5,628,394 | A | | 5/1997 | Benke et al. |
| 5,631,798 | A | | 5/1997 | Seymour et al. |
| 5,637,000 | A | | 6/1997 | Osterbrock et al. |
| 5,654,857 | A | | 8/1997 | Gershen |
| 5,655,648 | A | | 8/1997 | Rosen et al. |
| 5,661,623 | A | | 8/1997 | McDonald et al. |
| 5,680,287 | A | | 10/1997 | Gernhardt et al. |
| 5,694,280 | A | | 12/1997 | Zhou |
| 5,702,259 | A | | 12/1997 | Lee |
| 5,706,155 | A | | 1/1998 | Neiger et al. |
| 5,710,399 | A | | 1/1998 | Castonguay et al. |
| 5,715,125 | A | | 2/1998 | Neiger et al. |
| 5,719,363 | A | | 2/1998 | Händler |
| 5,729,417 | A | | 3/1998 | Neiger et al. |
| 5,805,397 | A | | 9/1998 | MacKenzie |
| 5,815,363 | A | | 9/1998 | Chu |
| 5,825,602 | A | | 10/1998 | Tosaka et al. |
| 5,839,909 | A | | 11/1998 | Calderara et al. |
| 5,844,765 | A | | 12/1998 | Kato et al. |
| 5,846,092 | A | | 12/1998 | Feldman et al. |
| 5,847,913 | A | | 12/1998 | Turner et al. |
| 5,849,878 | A | | 12/1998 | Cantor et al. |
| 5,875,087 | A | | 2/1999 | Spencer et al. |
| 5,877,925 | A | | 3/1999 | Singer |
| 5,902,140 | A | | 5/1999 | Cheung et al. |
| 5,915,981 | A | | 6/1999 | Mehta |
| 5,917,686 | A | | 6/1999 | Chan et al. |
| 5,920,451 | A | | 7/1999 | Fasano et al. |
| 5,933,063 | A | | 8/1999 | Keung et al. |
| 5,943,198 | A | | 8/1999 | Hirsh et al. |
| 5,943,199 | A | | 8/1999 | Aromin |
| 5,956,218 | A | | 9/1999 | Berthold |
| 5,963,408 | A | | 10/1999 | Neiger et al. |
| 6,021,034 | A | | 2/2000 | Chan et al. |
| 6,040,967 | A | | 3/2000 | DiSalvo |
| 6,052,265 | A | | 4/2000 | Zaretsky et al. |
| 6,086,391 | A | | 7/2000 | Chiu |
| 6,111,210 | A | | 8/2000 | Allison |
| 6,149,446 | A | | 11/2000 | Yu |
| 6,180,899 | B1 | | 1/2001 | Passow |
| 6,204,743 | B1 | | 3/2001 | Greenberg et al. |
| 6,217,353 | B1 | | 4/2001 | Yu-Tse |
| 6,224,401 | B1 | | 5/2001 | Yu |
| 6,226,161 | B1 | | 5/2001 | Neiger et al. |
| 6,232,857 | B1 | | 5/2001 | Mason, Jr. et al. |
| 6,238,224 | B1 | | 5/2001 | Shao |
| 6,242,993 | B1 | | 6/2001 | Fleege et al. |
| 6,246,558 | B1 | | 6/2001 | DiSalvo et al. |
| 6,252,407 | B1 | | 6/2001 | Gershen |
| 6,255,923 | B1 | | 7/2001 | Mason, Jr. et al. |
| 6,259,340 | B1 | | 7/2001 | Fuhr et al. |
| 6,282,070 | B1 | | 8/2001 | Ziegler et al. |
| 6,288,882 | B1 | | 9/2001 | DiSalvo et al. |
| 6,299,487 | B1 | | 10/2001 | Lopata et al. |
| 6,309,248 | B1 | | 10/2001 | King |
| 6,324,043 | B1 | | 11/2001 | Turner |
| 6,381,112 | B1 | | 4/2002 | DiSalvo |
| 6,381,113 | B1 | | 4/2002 | Legatti |
| 6,422,880 | B1 | | 7/2002 | Chiu |
| 6,437,700 | B1 | | 8/2002 | Herzfeld et al. |
| 6,437,953 | B2 | | 8/2002 | DiSalvo et al. |
| D462,660 | S | | 9/2002 | Huang et al. |
| 6,537,088 | B2 | | 3/2003 | Huang |
| 6,537,089 | B1 | | 3/2003 | Montague |
| 6,545,574 | B1 | | 4/2003 | Seymour et al. |
| 6,558,928 | B1 | | 5/2003 | Landegren |
| 6,580,344 | B2 | | 6/2003 | Li |
| 6,590,172 | B1 | | 7/2003 | Gadre et al. |

| | | | |
|---|---|---|---|
| 6,590,753 | B1 | 7/2003 | Finlay |
| 6,621,388 | B1 | 9/2003 | Macbeth |
| 6,628,486 | B1 | 9/2003 | Macbeth |
| 6,646,838 | B2 | 11/2003 | Ziegler et al. |
| 6,657,834 | B2 | 12/2003 | DiSalvo |
| 6,670,870 | B2 | 12/2003 | Macbeth |
| 6,670,872 | B2 | 12/2003 | Kurzmann |
| 6,671,145 | B2 | 12/2003 | Germain et al. |
| 6,693,779 | B2 | 2/2004 | DiSalvo |
| 6,717,782 | B2 | 4/2004 | DiSalvo et al. |
| 6,734,769 | B1 | 5/2004 | Germain et al. |
| 6,749,449 | B2 | 6/2004 | Mortun et al. |
| 6,767,228 | B2 | 7/2004 | Katz |
| 6,771,152 | B2 | 8/2004 | Germain et al. |
| 6,776,630 | B1 | 8/2004 | Huang |
| 6,786,745 | B1 | 9/2004 | Huang |
| 6,788,173 | B2 | 9/2004 | Germain et al. |
| 6,813,126 | B2 | 11/2004 | DiSalvo et al. |
| 6,828,886 | B2 | 12/2004 | Germain et al. |
| 6,842,095 | B2 | 1/2005 | Macbeth |
| 6,873,231 | B2 | 2/2005 | Germain et al. |
| 6,864,766 | B2 | 3/2005 | DiSalvo et al. |
| 6,864,769 | B2 | 3/2005 | Germain et al. |
| 6,893,275 | B2 | 5/2005 | Ng et al. |
| 6,900,972 | B1 | 5/2005 | Chan et al. |
| 6,930,574 | B2 | 8/2005 | Gao |
| 6,937,451 | B2 | 8/2005 | Ulrich et al. |
| 6,944,001 | B2 | 9/2005 | Ziegler et al. |
| 6,949,994 | B2 | 9/2005 | Germain et al. |
| 6,958,895 | B1 | 10/2005 | Radosavljevic et al. |
| 6,963,260 | B2 | 11/2005 | Germain et al. |
| 6,969,801 | B2 | 11/2005 | Radosavljevic et al. |
| 6,975,192 | B2 | 12/2005 | Disalvo |
| 6,975,492 | B2 | 12/2005 | DiSalvo |
| 6,979,212 | B1 | 12/2005 | Gorman |
| 6,982,856 | B2 | 1/2006 | Bernstein |
| 6,986,674 | B1 | 1/2006 | Gorman |
| 6,998,945 | B2 | 2/2006 | Huang et al. |
| 7,019,952 | B2 | 3/2006 | Huang et al. |
| 7,026,895 | B2 | 4/2006 | Germain et al. |
| 7,031,125 | B2 | 4/2006 | Germain et al. |
| 7,042,688 | B2 | 5/2006 | Chan et al. |
| 7,049,910 | B2 | 5/2006 | Campolo et al. |
| 7,049,911 | B2 | 5/2006 | Germain et al. |
| 7,082,021 | B2 | 7/2006 | Chan et al. |
| 7,088,205 | B2 | 8/2006 | Germain et al. |
| 7,088,206 | B2 | 8/2006 | Germain et al. |
| 7,177,126 | B2 | 2/2007 | Ulrich et al. |
| 7,179,992 | B1 | 2/2007 | Packard et al. |
| 7,195,500 | B2 | 3/2007 | Huang et al. |
| 7,209,330 | B2 | 4/2007 | DiSalvo |
| 7,227,435 | B2 | 6/2007 | Germain et al. |
| 7,265,956 | B2 | 9/2007 | Huang |
| 7,289,306 | B2 | 10/2007 | Huang |
| 7,295,415 | B2 | 11/2007 | Huang et al. |
| 7,315,227 | B2 | 1/2008 | Huang et al. |
| 7,317,600 | B2 | 1/2008 | Huang et al. |
| 2002/0064779 | A1 | 5/2002 | Landegren et al. |
| 2003/0005783 | A1 | 1/2003 | Chen et al. |
| 2003/0151478 | A1 | 8/2003 | Radosavljevic et al. |
| 2004/0147148 | A1* | 7/2004 | Ng et al. ..... 439/137 |
| 2005/0002138 | A1 | 1/2005 | Germain et al. |
| 2005/0063110 | A1 | 3/2005 | DiSalvo et al. |
| 2006/0007611 | A1 | 1/2006 | Ziegler et al. |
| 2006/0132266 | A1 | 6/2006 | DiSalvo |
| 2006/0139132 | A1 | 6/2006 | Porter et al. |
| 2006/0273859 | A1 | 12/2006 | Germain et al. |
| 2007/0049077 | A1 | 3/2007 | Germain |
| 2007/0049079 | A1 | 3/2007 | Nalwad et al. |
| 2007/0111569 | A1 | 5/2007 | Germain et al. |
| 2007/0114053 | A1 | 5/2007 | Castaldo et al. |
| 2007/0126539 | A1 | 6/2007 | DiSalvo |
| 2007/0211397 | A1 | 9/2007 | Sokolow et al. |

FOREIGN PATENT DOCUMENTS

| | | |
|---|---|---|
| AU | 775072 | 10/2004 |
| DE | 28 21 138 | 11/1978 |
| DE | 3 431 581 | 3/1986 |
| EP | 0 081 661 | 6/1983 |
| EP | 0 526 071 | 2/1993 |
| ES | 21345 | 5/1977 |
| FR | 2391549 | 12/1978 |
| GB | 227930 | 1/1925 |
| GB | 830018 | 3/1960 |
| GB | 2207823 | 2/1989 |
| GB | 2 290 181 | 12/1995 |
| GB | 2 292 491 | 2/1996 |
| JP | 61 259428 | 11/1986 |
| WO | WO 96/01484 | 1/1996 |
| WO | WO 00/11696 | 3/2000 |
| WO | WO 00/45366 | 8/2000 |
| WO | WO 01/15183 | 3/2001 |
| WO | WO 02/33720 | 4/2002 |
| WO | WO 2004/070751 | 8/2004 |
| WO | WO 2004/070752 | 8/2004 |

* cited by examiner

ELECTRICAL WIRING DEVICES WITH A PROTECTIVE SHUTTER

BACKGROUND

1. Field

The present disclosure is directed toward electrical wiring devices with user accessible connections and a shutter system for preventing unwanted objects from being inserted into the user accessible connections of the devices.

2. Description of the Related Art

Many electrical wiring devices have a line side, which is connectable to an electrical power supply, a load side, which is connectable to one or more loads, a user accessible connection connected to the load side, and at least one conductive path between the line and load sides. Electrical connections to wires supplying electrical power or wires conducting electricity to the one or more loads are at line side and load side connections, and electrical connections to user accessible loads are typically connected to the load side connections. With electrical wiring devices with user accessible loads, e.g., single and duplex receptacles, user safety is a major concern. Further, the electrical wiring device industry has witnessed an increasing call for circuit breaking devices or systems which are designed to interrupt power to various loads, such as household appliances, consumer electrical products and branch circuits. In particular, electrical codes require electrical circuits in home bathrooms and kitchens to be equipped with ground fault circuit interrupters (GFCI), for example. Presently available GFCI devices, such as the device described in commonly owned U.S. Pat. No. 4,595,894, use an electrically activated trip mechanism to mechanically break an electrical connection between the line side and the load side. Such devices are resettable after they are tripped by, for example, the detection of a ground fault.

Electrical wiring devices such as standard single and duplex type electrical receptacles, and some of the circuit interrupting devices noted above also have user accessible load connections, where the load side connection and user accessible load connection are typically electrically connected together. In such electrical wiring devices, the line and load side connections are binding screws and the user accessible connection is a plug connection to a contact or receptacle located inside the device and accessible through the face plate of the electrical wiring device. To protect users from inadvertently or unknowingly inserting one or more objects into the internal receptacle, well known non-conductive safety plugs that can be inserted through the face plate to block access to the internal receptacle have been utilized. The present disclosure contemplates other techniques for protecting users from inadvertently or unknowingly inserting one or more objects into the internal receptacle of an electrical wiring device.

SUMMARY

The present disclosure is directed electrical wiring devices with user accessible connections and a shutter system for preventing unwanted objects from being inserted into the devices to the user accessible connections. In one embodiment of such an electrical wiring device a housing having a top cover with at least one set of two slots is provided. The slots are configured to permit insertion of a load connection device into the housing to a user accessible connection within the housing. A shutter is provided to prevent unwanted objects from being inserted into the housing to the user accessible connection. The shutter is moveable between a blocking position relative to the at least one set of slots and an open position relative to the at least one set of slots. Preferably, movement of the shutter from the blocking position to the open position is facilitated upon insertion of a load connection device into the slots.

Preferably, the electrical wiring device is a receptacle having a set of blade receiving slots and wherein the shutter when in the blocking position is between the set of blade slots and the user accessible connection. In one embodiment, the shutter includes a pair of inclined surfaces wherein one inclined surface is aligned with one blade receiving slot and the other inclined surface is aligned with the other blade receiving slot. In this configuration, when at least a portion of load connection device, e.g., the blades of a plug assembly, is inserted into the set of slots, that portion engages the inclined surfaces. If the pressure applied to the inclined surfaces is equally distributed or substantially the same the shutter can move from the blocking position to the open position.

In an alternative embodiment of such an electrical wiring device, housing means with at least one set of slots is provided. The housing means is configured to permit the insertion of a load connection device into the housing means and electrically connects the load connection device to user accessible contacts or receptacles located inside the housing means. Shutter means located relative to the slots in the housing means is also provided. The shutter means is at least partially moveable between a blocking position relative to the housing means slots and an open position relative to the at least two slots in the housing. Preferably, the shutter means is movable from the blocking position to the open position upon insertion of a load connection device into the slots.

BRIEF DESCRIPTION OF THE DRAWINGS

Preferred embodiments of the present application are described herein with reference to the drawings in which similar elements are given similar reference characters, wherein.

DETAILED DESCRIPTION OF EMBODIMENTS

Figure 1:
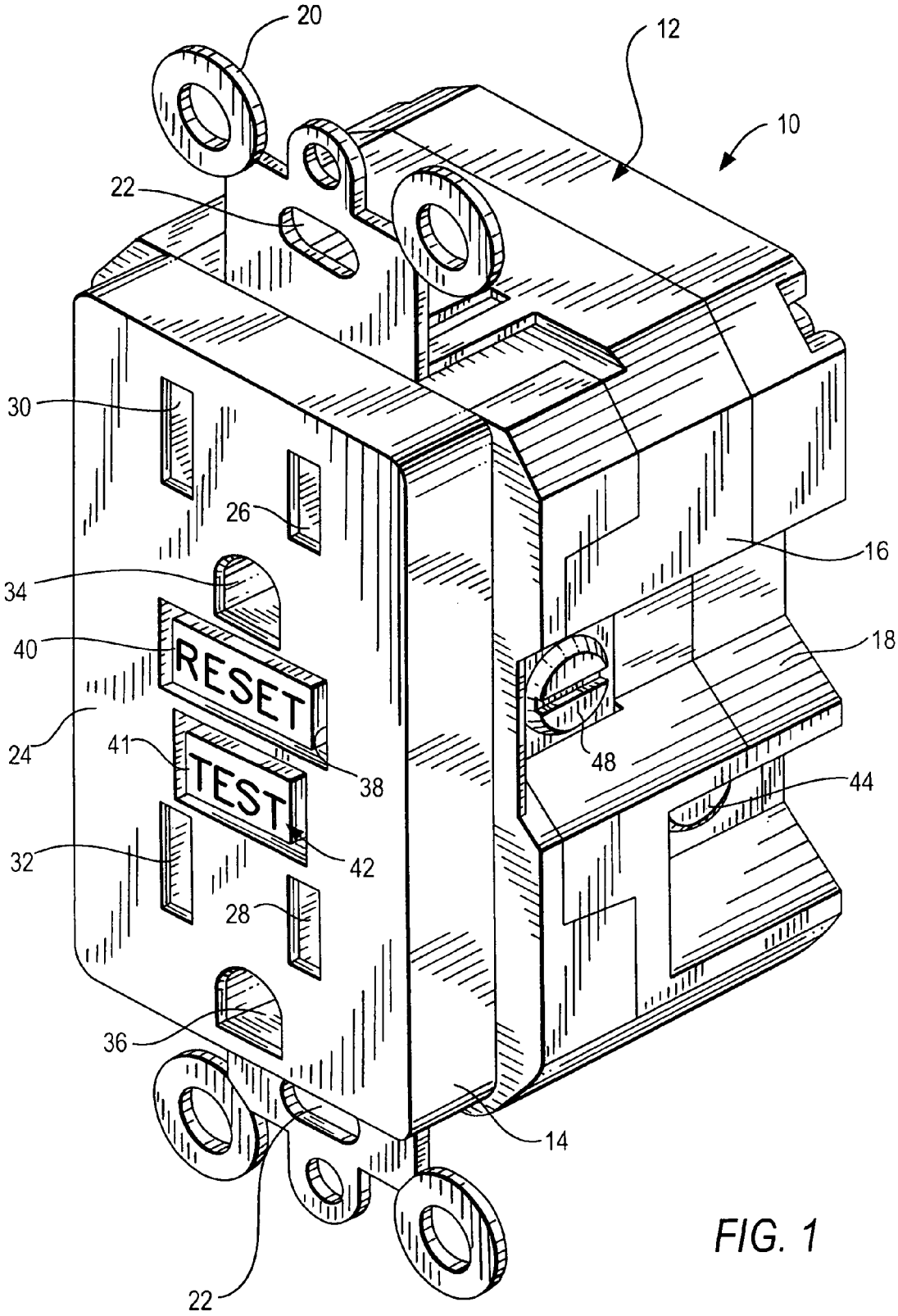
FIG. 1 is a perspective view of an electrical wiring device with user accessible connections.

The present disclosure contemplates shutter assemblies capable of being used with various types of electrical wiring devices with user accessible connections, e.g., electrical receptacles, used in residential, commercial and industrial environments. Examples of such electrical receptacles include single and duplex receptacles found in, for example, residential wiring environments or circuit interrupting devices that are capable of breaking at least one conductive path at a line side or a load side of the device. In such circuit interrupting devices the conductive path is typically divided between a line side that connects to supplied electrical power and a load side that connects to one or more loads (e.g., secondary loads and user accessible loads). Various receptacles in the family of resettable circuit interrupting devices include: ground fault circuit interrupters (GFCI's), arc fault circuit interrupters (AFCI's), immersion detection circuit interrupters (IDCI's), appliance leakage circuit interrupters (ALCI's) and equipment leakage circuit interrupters (ELCI's).

The receptacle shown herein is a GFCI type circuit interrupting receptacle having line and load phase (or power) connections, line and load neutral connections and user accessible load phase and neutral connections. The user accessible load connections permit external loads, such as appliances, lighting fixtures or other types of loads to be connected to the device.

With circuit interrupting devices, the circuit interrupting and reset portions preferably use electromechanical components to break (open) and make (close) one or more conductive paths between the line and load sides of the device. However, electrical components, such as solid state switches and supporting circuitry, may be used to open and close the conductive paths. Generally, the circuit interrupting portion is used to automatically break electrical continuity in one or more conductive paths (i.e., open the conductive path) between the line and load sides upon the detection of a fault, which in a GFCI type device is a ground fault. The reset portion is used to close the open conductive paths. In embodiments of a circuit interrupting device having a reset lockout, all or part of the reset portion is used to close the open conductive paths if allowed by the reset lockout. In this configuration, the operation of the reset and reset lockout portions is in conjunction with the operation of all or a portion of the circuit interrupting portion, so that electrical continuity in open conductive paths cannot be reset if all or a part of the circuit interrupting portion is non-operational, if an open neutral condition exists and/or if the device is reverse wired.

The above-described features can be incorporated in any resettable circuit interrupting device, but for simplicity the device shown and described is a GFCI type receptacle. A more detailed description of a GFCI receptacle is provided in U.S. Pat. Nos. 4,595,894 and 6,437,700 both of which are incorporated herein in its entirety by reference.

It should also be noted that binding screws are exemplary of the types of wiring terminals that can be used to provide the electrical connections in most receptacles. Examples of other types of wiring terminals include set screws, pressure clamps, pressure plates, push-in type connections, pigtails and quick-connect tabs.

Turning to FIG. 1, an exemplary embodiment of a GFCI type circuit interrupting receptacle is shown. The GFCI receptacle 10 according to the present disclosure is made up of a housing 12 having a top cover 14, middle housing 16 and a bottom housing 18 held in assembly by, for example, screws or deflectable tabs (not shown) mounted on the bottom housing that engage members on the top cover 14. A mounting strap 20 is mounted between top cover 14 and middle housing 16 and has two apertures 22 used to mount the GFCI receptacle 10 to the mounting ears of a standard gang box (not shown).

Figures 2, 3:
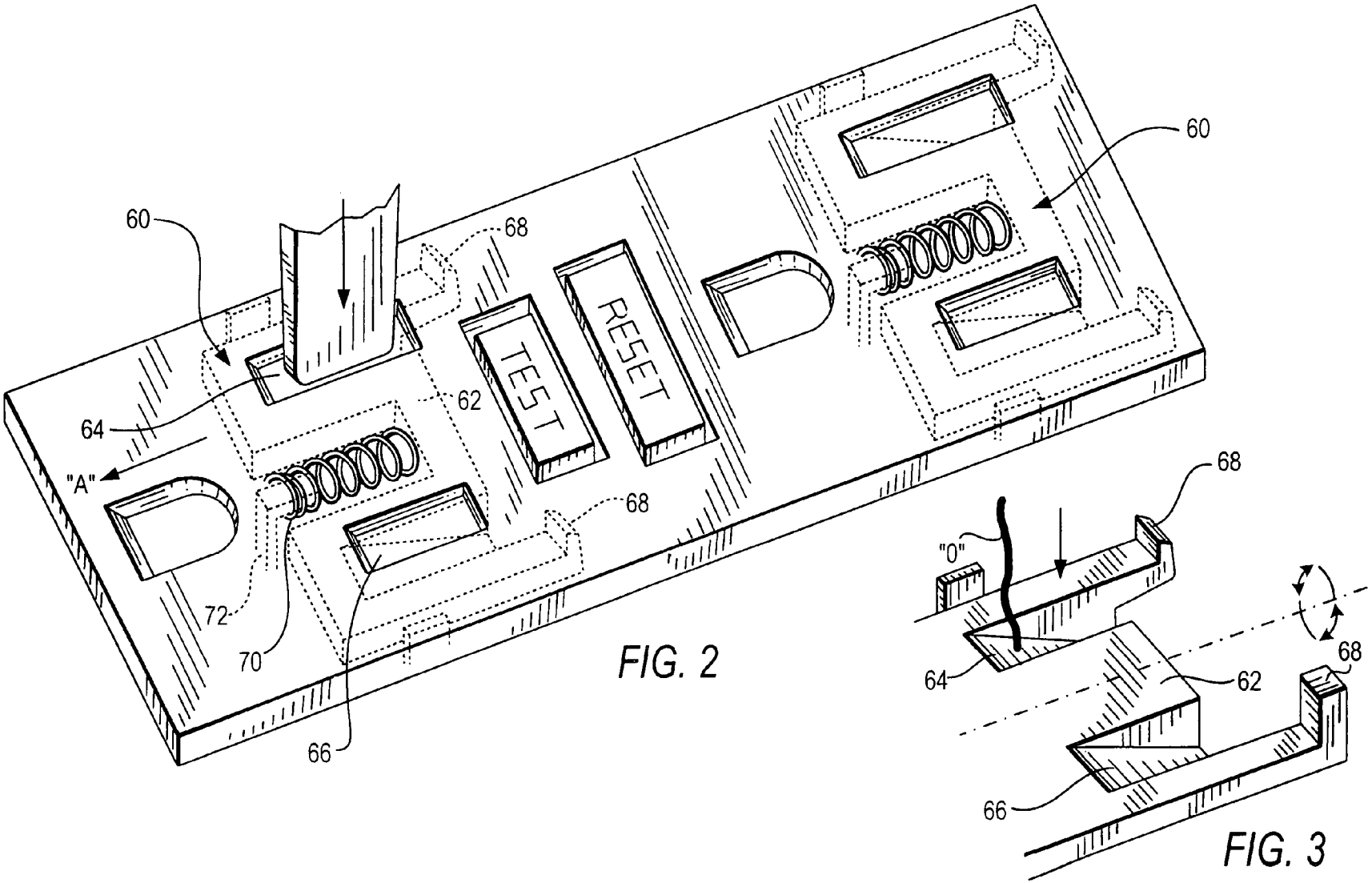
FIG. 2 is a perspective view of an electrical wiring device with user accessible connections having a top cover and shutter assembly.
FIG. 3 is a perspective view of an exemplary shutter.

The top cover 14 has a face 24 which contains two sets of slots that provide access to the user accessible line and phase connections of the receptacle. Preferably, each set of slots includes two or more blade receiving slots. FIG. 2 shows two sets of three blade receiving slots, where two of the blade receiving slots are configured to receive the phase and neutral blades (or prongs) of a plug assembly, and the third blade receiving slot is configured to receive the ground blade (or prong) of a plug assembly. In the opening 38 in top cover 14 is placed a reset button 40 and in opening 41 in top cover 14 is placed a test button 42.

In the embodiment of FIG. 2, each set of slots are made up of a blade receiving slot 26, 28 of a first length and a blade receiving slot 30, 32 of a longer length and a U-shaped blade receiving slot 34, 36 to receive the grounding blade of the plug assembly. Because the blade receiving slots 30, 32 are longer than the blade receiving slots 26, 28 the plug is naturally polarized and conforms to NEMA standard 5-15R.

The bottom housing 18 has a series of four terminal screws (only two of which are shown in the figures). Terminal screw 44 is connected to the load neutral terminal. A similar terminal screw on the other side of the housing 12 is connected to the load phase terminal. Terminal screw 48 is connected to the line neutral terminal and a similar terminal screw on the other side of the housing is connected to the line phase terminal. At the rear wall of middle housing 16 is a grounding screw (not shown) to which a ground conductor may be fastened.

Referring again to FIG. 2, the present disclosure provides a shutter assembly for each set of blade receiving slots that is used to help prevent unwanted insertion of objects into the user accessible load phase and neutral connections of the receptacle, e.g., the connection where the blades (or prongs) of a plug assembly are inserted. The shutter assembly may be located on the face portion 24 of the top cover 14 or the shutter assembly may be located on the inside portion of the top cover 14, or at another location inside the housing 12.

Figure 4:
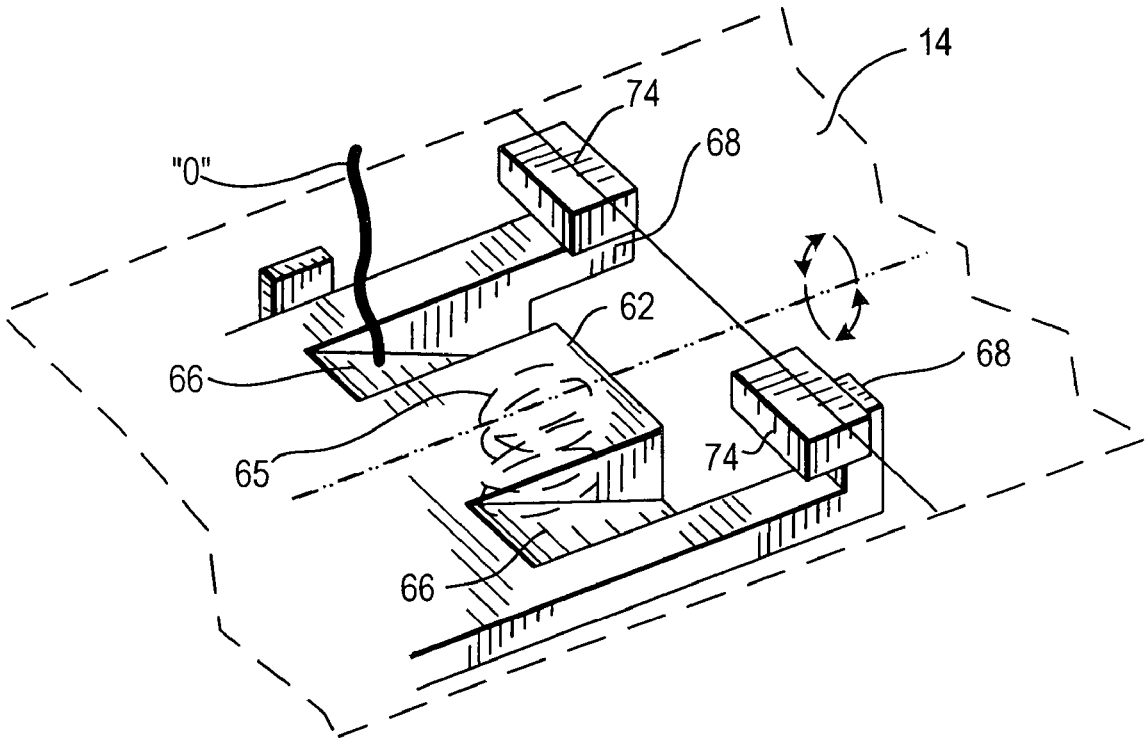
FIG. 4 is a perspective view of an exemplary shutter similar to FIG. 3.

As shown in FIGS. 2-4, the shutter assembly 60 includes a shutter 62 movable between open and blocking positions, and spring 70 connected between the shutter 62 and spring support 72 to normally bias the shutter to the closed position. Spring 65 (seen in FIG. 4) is provided to normally bias the shutter 62 toward the inside of the top cover 14 to reposition the shutter relative to the blade receiving slots when the shutter is in the blocking position. The blocking position of the shutter is a position where the blocking surfaces 64 and 66 block the path between a blade receiving slot in the top cover 14 and the user accessible connection inside the device. The open position of the shutter is a position where the blocking surfaces 64 and 66 do not block the paths between a blade slots in the top cover 14 and the user accessible connections inside the device. Preferably, one blocking surface 64 is aligned with blade receiving slot, e.g. 32, in the top cover 14 and the other blocking surface 66 is aligned with blade receiving slot, e.g. 28, in the top cover 14. Stops 68 are provided on the shutter and used to engage the inside of the top cover 14 to prevent the shutter from moving to the open position as described below. The stops may have pointed surfaces, or they may have flat surfaces or any other type of configuration that would be sufficient to prevent movement of the shutter in the direction of arrow "A". For example, the stops may be configured to engage a stop catch 74, such as a detent or indent in the top cover 14 or another suitable structure may be secured to the top cover 14 to engage the stop.

Referring to FIG. 3, the blocking surfaces are preferable inclined surfaces configured to move in the direction of arrow "A" when the blades of a plug assembly are inserted into the slots in the top cover 14 and engage the blocking surfaces. When the blades of the plug assembly engage the respective blocking surface 64 or 66, substantially equal pressure is applied to the blocking surfaces causing the stops to disengage the stop catch 74 and permitting free movement of the shutter in the direction of arrow "A". If an object "O" were inserted into one of the slots 28, 32 in the top cover it would engage one blocking surface causing rotational movement of the shutter. A spring (not shown) located under the shutter urges the shutter to rotate to its at rest position. As a result, one stop, e.g., stop 68, would not disengage from the stop catch 74 so that the shutter is not permitted to move in the direction of arrow "A". Although the movement of the shutter from the blocking position to the open position is shown as a sliding movement, the present disclosure also contemplates other types of movement of the shutter between the blocking position and the open position, such as rotational movement.

Although the shutter is described as a movable shutter with inclined blocking surfaces and stops, other configurations of the shutter, blocking surfaces and stops are also contemplated that are capable of performing the same or substantially the same function. For example, the stops may be configured to engage other structures on the top cover or on another component of the receptacle, or electromechanical components may be utilized to block unwanted objects from entering the receptacle. Further, the shutter assembly may be employed on any type of device with user accessible connections, including single and duplex receptacles and circuit interrupting devices.

While there have been shown and described and pointed out the fundamental features of the disclosure, it will be understood that various omissions and substitutions and changes of the form and details of the device described and illustrated and in its operation may be made by those skilled in the art, without departing from the spirit of the application.

What is claimed:

1. A GFCI receptacle with at least one set of user accessible connections within the wiring device comprising:

a housing having a top cover with an accessible test button and reset button and having a front surface, a rear surface and at least two slots aligned with the at least one set of user accessible connections for receiving the prongs of a load connection device;

a shutter positioned between the top cover and directly above the user accessible connections and being moveable from a slot obstructing position and a slot open position by the insertion of the prongs of the load connection device into the slots;

a first spring coupled to urge the shutter to move in a first direction along the rear surface of the top cover to the slot obstructing position;

at least one spring support coupled to said housing and to said first spring inside of said first spring;

a first and second stop catches coupled to the rear surface of the top cover;

a first stop coupled to the shutter and positioned to engage the first stop catch on the top cover and a second stop coupled to the shutter and positioned to engage the second stop catch on the top cover; and a second spring coupled to urge the shutter to move in a second direction toward the rear surface of the top cover and transverse to the direction of movement of the shutter caused by the first spring to cause the stop on the shutter to engage and pivot about only one stop catch on the rear surface of the top cover to prevent the shutter from moving from its blocking position to its open position when an object is inserted into only one of the at least two slots of the top cover.

2. The electrical wiring device according to claim 1, wherein the shutter movement from the slot obstructing position to the slot open position is a sliding movement along the rear surface of the top cover in combination with a movement away from the rear surface of the top cover as the prongs of a load connection device are inserted into the at least two slots.

3. The electrical wiring device of claim 1 wherein said first spring is a coil spring.

4. The electrical wiring device as in claim 1, wherein said shutter has at least two inclined surfaces, wherein when said at least two inclined surfaces are contacted by at least two prongs of a plug said shutter moves along a length of an associated blade receiving slot.

5. The electrical wiring device as in claim 1, wherein said second spring is in direct contact with said shutter.

6. The electrical wiring device according to claim 1 wherein the shutter includes a pair of inclined surfaces wherein one inclined surface is aligned with one prong receiving slot and the other inclined surface is aligned with the other prong receiving slot, such that when at least a portion of the prongs of the load connection device is inserted into the at least two prong receiving slots, that portion engages the inclined surfaces.

7. The electrical wiring device according to claim 6, wherein when the portion of a load connection device is inserted into the set of prong receiving slots, that portion engages the inclined surfaces of the shutter and upon substantially equal pressure applied to the inclined surfaces, allows the shutter to move from the obstructing position to the open position.

8. The electrical wiring device according to claim 7, wherein the receptacle is a duplex receptacle with two sets of at least two prong slots and a shutter for each set of prong slots.

9. A GFCI receptacle with at least one set of user accessible connections within the wiring device comprising:

a housing having a top cover with an accessible test button and reset button and having a front surface, a rear surface and at least two slots aligned with the at least one set of user accessible connections for receiving the prongs of a load connection device;

a shutter positioned between the top cover and directly above the user accessible connections and being moveable from a slot obstructing position and a slot open position by the insertion of the prongs of the load connection device into the slots;

a first spring coupled to urge the shutter to move in a first direction along the rear surface of the top cover to the slot obstructing position;

a first and second stop catches coupled to the rear surface of the top cover;

a first stop coupled to the shutter and positioned to engage the first stop catch on the top cover and a second stop coupled to the shutter and positioned to engage the second stop catch on the top cover; and a second spring in direct contact with the shutter to move the shutter in a second direction toward the rear surface of the top cover and transverse to the direction of movement of the shutter caused by the first spring to cause the stop on the shutter to engage and pivot about only one stop catch on the rear surface of the top cover to prevent the shutter from moving from its blocking position to its open position when an object is inserted into only one of the at least two slots of the top cover.

* * * * *